United States Patent [19]

Ikeda

[11] Patent Number: 4,466,317

[45] Date of Patent: Aug. 21, 1984

[54] METHOD AND APPARATUS FOR SAFETY FOR PRESSES

[75] Inventor: Nobuyuki Ikeda, Hatano, Japan

[73] Assignee: Amada Company Limited, Japan

[21] Appl. No.: 407,583

[22] Filed: Aug. 12, 1982

[30] Foreign Application Priority Data

Aug. 18, 1981 [JP] Japan ..... 56-128245

[51] Int. Cl.[3] ..... B26D 7/24

[52] U.S. Cl. ..... 83/55; 83/62.1; 83/221; 83/399; 192/129 A

[58] Field of Search ..... 83/62.1, 62, 58, 221, 83/399, 400, 13, 55; 192/129 A; 234/32, 33

[56] References Cited

U.S. PATENT DOCUMENTS 4,205,567 6/1980 Hirata et al. ..... 83/62.1 X

*Primary Examiner*—James M. Meister

*Attorney, Agent, or Firm*—Wigman & Cohen

[57] ABSTRACT

A method of and apparatus for controlling the movement of a workpiece to be processed in a punch press is disclosed in which after the workpiece is processed by contact of a ram on the upper tool of the press and the ram is momentarily out of contact with the upper tool, the recontact of the ram and upper tool is detected and then the processed workpiece is moved out of the processing position. In addition, the apparatus detects when the ram has returned to the proximity of the top dead center of the eccentric shaft which drives the ram and when the processing of the workpiece has been completed. The apparatus is also provided with a monitoring system which detects a malfunction in the control apparatus.

4 Claims, 5 Drawing Figures

METHOD AND APPARATUS FOR SAFETY FOR PRESSES

BACKGROUND OF THE INVENTION

1. Field of the Invention

The present invention relates generally to presses and the like having a ram and upper and lower tools for processing workpieces such as sheet metals and, more particularly, to a method and apparatus for providing a safety device against troubles or malfunctions of the tools of the presses.

2. Description of the Prior Art

As is well known, presses are provided with a vertically movable ram and upper and lower tools or dies which are worked by the ram to cooperate with each other to process workpieces such as sheet metals. In most cases, the upper and lower tools are unitized as a tool assembly or die set to be mounted on a work-table just beneath the ram for convenience of installation and for other reasons. Otherwise, the upper and lower tools are held on a tool holding means, such as a pair of turret members, which are so designed as to hold a number of upper and lower tools and selectively bring a desired pair of upper and lower tools into position just under the ram.

In the case where the upper and lower tools are employed as an unitized tool assembly or die set or used on holding means such as turret members, the upper tool is so arranged as to be drawn up or stripped by a stripping spring out of a workpiece to be processed after each completion of processing cycles. More particularly, such a stripping spring is so disposed as to be compressed when the ram is urging the upper tool toward the workpiece and the lower tool and then lift up or strip the upper tool out of contact with the workpiece.

Especially in punching and blanking operations, however, the upper tool will often fail to be stripped out of the workpiece after a completion of a processing cycle. This arises from various causes, such as breakage or fatigue of the stripping spring and wear or thermal expansion of the upper tool. Of course, when the upper tool is mis-stripped or not stripped out of the workpiece in punching and blanking operations, it often happens that the upper tool will be caught not only in the workpiece but also in the lower tool. Anyway, it is very dangerous when the upper tool is mis-stripped or fails to be stripped from the workpiece, since the press will go on moving with the upper tool caught in the workpiece. Also, any or all of the upper and lower tools, the workpiece and the press will be damaged or broken if the workpiece is forcibly moved by power when the upper tool is caught in the workpiece because of mis-stripping. Since workpieces are usually moved or fed into presses automatically by power, especially in punching and blanking operations, it has been disadvantageous that damages to tools, workpieces and presses frequently occurs when the upper tool is caught in the workpiece because of mis-stripping.

For the above described reasons, it is necessary to move and feed the workpiece after the upper tool has been completely stripped from the workpiece without being mis-stripped. Of course, it is necessary to stop the workpiece from being moved and to also stop the press from being driven the moment the upper tool is caught in the workpiece because of mis-stripping, especially when the workpiece is being automatically fed by power. In other words, it is necessary to detect mis-stripping of the upper tool to stop the workpiece and the press from being moved the moment the upper tool is mis-stipped.

Heretofore, various attempts have been made to detect mis-stripping of upper tools in presses in order to stop workpieces and presses from being moved the moment mis-strippings occur. For example, a photoelectric tube is employed so that it may check each return of the upper tool to its normal position after each completion of processing cycles so as to stop the workpiece and the press when the upper tool is not normally returned to its position. Generally, the conventional arrangement has been such that each stripping of the upper tool from the workpiece is checked when the upper tool has passed or cleared, in returning, a fixed point at which it is to be stripped out of a workpiece of the maximum thickness which can be processed. Therefore, in the conventional devices for detecting mis-stripping of the upper tool, the workpiece cannot be moved until the upper tool has passed or cleared a fixed point whether workpieces being actually processed are large or small in thickness. Accordingly, it has been disadvantageous with regard to conventional mis-stripping detecting devices that the processing speed is limited in spite of the fact that a millisecond matters in punching and blanking operations. Also, it has been disadvantageous that the conventional mis-stripping devices are apt to perform erroneously from various causes when no mis-stripping occurs.

SUMMARY OF THE INVENTION

It is therefore a general object of the present invention to provide a method and apparatus for a safety device for presses in which mis-strippings of the upper tool out of workpieces to be processed in presses can be securely and quickly detected so as to stop the workpieces and the presses the moment the mis-strippings occur.

It is another object of the present invention to provide a method and apparatus in which mis-strippings of the upper tool out of workpieces to be processed in presses can be accurately detected as quickly as possible according to the thicknesses of the workpieces.

It is an object of the present invention to provide a method and apparatus in which workpieces to be processed in presses can be quickly moved as soon as the upper tool has been completely stripped out of the workpieces whether the workpieces are large or small in thickness.

Accordingly, it is a primary object of the present invention to provide a method and apparatus which enables a press to work at the highest speed possible and detects any mis-stripping of the upper tool out of a workpiece being processed and simultaneously stops the workpiece and the press.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENTS

Figure 1:
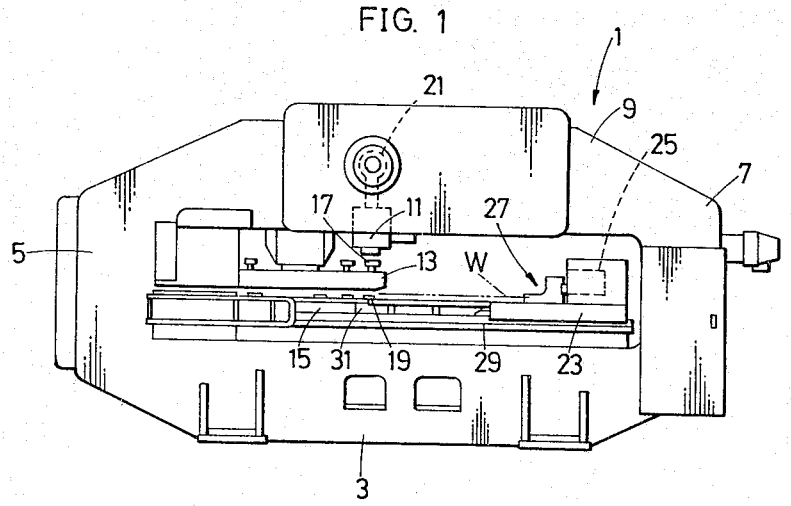
FIG. 1 is a front elevational view of a turret punch press embodying the principles of the present invention.

Referring to FIG. 1, there is shown a turret punch press in which the principles of the present invention can be embodied for the purpose of describing the principles of the present invention. However, it is to be initially noted that the present invention is not limited in application to the turret punch press 1 and it is applicable to various types of presses and other machine tools.

The turret punch press 1 is constructed of a base 3, a pair of side frames 5 and 7 vertically fixed or formed to the ends of the base 3 and an overhead frame 9 which is supported over the base 3 by the side frames 5 and 7. Also, the turret punch press 1 comprises a ram 11 and a pair of an upper urret 13 and a lower turret 15 holding a plurality of upper tools 17 and lower tools 19, respectively, which are varied in size and shape. The ram 11 is vertically movably mounted at the substantially midway portion of the overhead frame 9 to be vertically driven by power by an eccentric shaft 21 so as to act on the upper and lower tools 17 and 19 placed therebeneath. The upper turret 13 is so mounted as to rotatably hang from the overhead frame 9 with its shaft vertical to rotate partially beneath the ram 11, while the lower turret 15 is rotatably mounted on the base 3 just beneath the upper turret 13 in a coaxial relation therewith. Also, the upper and lower turrets 13 and 15 are so arranged that pairs of the upper and lower tools 17 and 19, common in size and shape, vertically align with each other, and in this arrangement they are simultaneously driven by power to bring a desired pair of the upper and lower tools 17 and 19 into position beneath the ram 11.

In order to feed and position a sheet-like workpiece W such as sheet metal to be punched, the turret punch press 1 is provided with a first carriage 23 which is movable toward and away from the upper and lower turrets 13 and 15 and a second carriage 25 which is slidably mounted on the first carriage 23 and holds a clamping apparatus 27 for clamping the workpiece W. The first carriage 23 is slidably mounted on rails 29 which are fixed on the upper portion of the base 3 so that it may be horizontally moved toward and away from the upper and lower turrets 13 and 15 when driven by power. The second carriage 25 holding the clamping apparatus 27 is mounted on the first carriage 23 so that it may be horizontally moved by power in all directions at right angles with the rails 29. The clamping apparatus 27 for clamping the workpiece W are usually a pair in number but may be more than two, and they are detachably and adjustably fixed to the second carriage 25 so that they may be adjusted in horizontal position on the second carriage 25 according to the width of the workpiece W. Also, a fixed table 31 is provided on the base 3 so that the workpiece W can be slid thereon, when moved and fed by the clamping apparatus 27.

In the above described arrangement, the workpiece W, which is gripped by the clamping apparatus 27, can be fed into place between the upper and lower turrets 13 and 15 and positioned just beneath the ram 11 by moving the first and second carriages 23 and 25. Before or as soon as the workpiece W is positioned between the upper and lower turrets 13 and 17 just beneath the ram 11, a desired pair of the upper and lower tools 17 and 19 are placed just beneath the ram 11 by the upper and lower turrets 13 and 15, and thus, the workpiece W is punched by the upper and lower tools 17 and 19 when the ram 11 is lowered by the eccentric shaft 21 to press the upper tool 17. Also, a number of holes varied in size and shape are automatically and continuously punched in the workpiece W by rotating the upper and lower turrets 13 and 15 and moving the first and second carriages 23 and 25 under a programmed numerical control.

Figure 2:
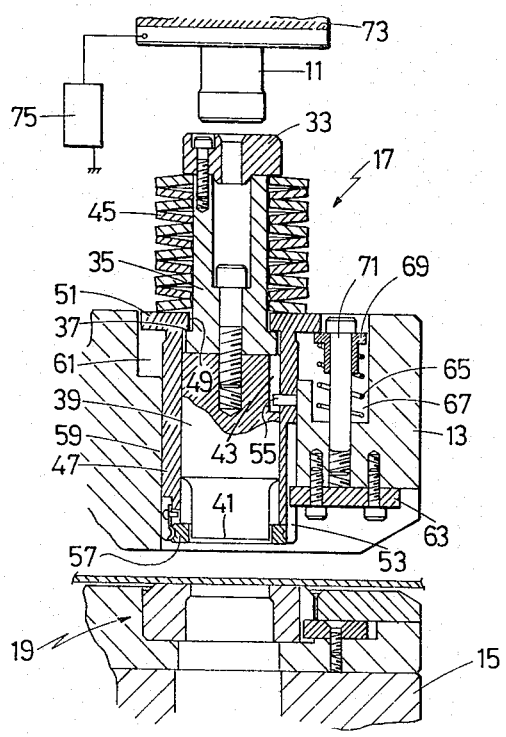
FIG. 2 is an enlarged partial view showing a portion of the turret punch press shown in FIG. 1.

Referring to FIG. 2, the upper and lower tools 17 and 19 are detachably held on the radial ends of the upper and lower turrets 13 and 15, respectively. In FIG. 2, the upper and lower turrets 13 and 15 are shown only partially as having positioned one pair of the upper and lower tools 17 and 19 just beneath the ram 11 to punch the workpiece W. However, it is to be understood that the upper and lower turrets 13 and 15 are so designed as to hold a number of pairs of the upper and lower tools 17 and 19 which are different in shape and size to be selectively used to punch a variety of holes on the workpiece W.

As shown in FIG. 2, each of the upper tools 17 consists of a flange-like head member 33, the shank portion 35 having a shoulder portion 37 and a cylindrical body portion 39 which is provided with a punching edge 41 and a vertical guide groove 43 at its side. Each of the upper tools 17 is provided at its shank portion 35 with a stripping spring 45 and is vertically slidably held in a tubal guide member 47 which is formed at its top end with an inner flange 49 and an outer flange 51 and is also formed at its outer side with a vertical guide groove 53. Specifically, the upper tool 17 is vertically slidably inserted in the tubal guide member 47 in a manner such that the body portion 39 is slidable in the tubal guide member 47 together with the shoulder portion 37 and the shank portion 35 is normally kept projected upwardly therefrom by the stripping spring 45. Also, the stripping spring 45 is resiliently provided on the shank portion 35 of the upper tool 17 in such a manner as to ride on the top end of the tubal guide member 47 to hold the upper tool 17 by means of the flange-like head member 33. Thus, the upper tool 17 will be vertically downwardly slid in the tubal guide member 47 when the flange-like head member 33 is pressed by the ram 11, but it is stopped from upwardly jumping out of the tubal guide member 47 by its inner flange 49 engaging with the shoulder portion 37. The upper tool 17, which is vertically slidably held in the tubal guide member 47 in this arrangement, is kept from rotating therein by a guide key member 55 which is fixed to the tubal guide member 47 and is in engagement with the guide groove 43 formed on the body portion 39. Also, the tubal guide member 47 is provided at its lower end with a ring-shaped hold-down member 57 which acts to hold the workpiece W being punched and also to guide the punching edge 41. Thus, it will be understood that the punching edge 41 of the upper tool 17 will be downwardly projected out of the tubal guide member 47 to punch the workpiece W placed therebeneath when the flange-like head member 33 is depressed by the ram 11 to compress the stripping spring 45.

The tubal guide member 47 holding the upper tool 17 is vertically slidably held in a tool-holding hole 59 which is vertically formed at the radial end portion of the upper turret 13. The tool-holding hole 59 is provided with an upper enlarged shoulder portion 61 so that the outer flange 51 at the tubal guide member 47 can be vertically moved therein when the tubal guide member 47 is at its lowermost position. Of course, it will be understood that a plurality of tool-holding holes 59 are formed apart from each other on the upper turret 13 to hold many of the upper tools 17. The tubal guide member 47 is stopped from rotating in the tool-holding hole 59 by a guide key member 63 which is fixed to a portion of the upper turret 13 in engagement with the guide groove 53 formed at the outer side of the tubal guide member 47. The tubal guide member 47 is resiliently held in the tool-holding hole 59 by a plurality of lift springs 65 so that it may be normally kept raised therein with the outer flange 51 being kept raised in the shoulder portion 61. Each of the lift springs 65 is resiliently provided in a vertical hole 67 which is formed on the upper turret 13 in connection with the upper portion of the tool-holding hole 59. Particularly, each of the lift springs 65 is so arranged as to resiliently hold the outer flange 51 of the tubal guide member 47 by means of a flanged tubal holding member 69 which is vertically movable in the vertical hole 67 along a guide member 71. In this connection, the arrangement is such that the stripping spring 45 is stronger in spring force that all the lift springs 65. Thus, when the flange-like head member 33 of the upper tool 17 is depressed by the ram 11, the tubal guide member 47 will be initially lowered by the stripping spring 45 against the lift springs 65 and then the punching edge 41 of the upper tool 17 will be projected out of the tubal guide member 47 against the stripping spring 45 after the lift springs 65 have been compressed.

In punching operations in the above described arrangement, when the ram 11 is lowered by the eccentric shaft 21 to press the upper tool 17, the tubal guide member 47 will be initially lowered against the lift springs 65, weaker than the stripping spring 45, to enable the holddown member 57 to hold down the workpiece W onto the lower tool 19. As soon as the hold member 57 is brought into contact with the workpiece W, the tubal guide member 47 will stop lowering and the upper tool 17 will begin to further lower in the tubal guide member 47 against the stripping spring 45 in such a manner as to bring the shoulder portion 37 away from the inner flange 49. Thus, while the tubal guide member 47 keeps holding down the workpiece W by means of the holddown means 57, the upper tool 17 will be lowered in the tubal guide member 47 to project the punching edge 41 downwardly therefrom so as to punch the workpiece W in cooperation with the lower tool 19. When the ram 11 is raised up by the eccentric shaft 21 after the workpiece W has been punched, the upper tool 17 will first be stripped out of the workpiece W by the stripping spring 45, which is stronger than the lift springs 65. Then, after the shoulder portion 37 has been brought up into contact with the inner flange 49 of the tubal guide member 47, the tubal guide member 47 will be raised together with the upper tool 17 by the lift springs 65 out of contact with the workpiece W to its original position. The same cycles as described above are repeated to continue punching operations, although the upper and lower turrets 13 and 15 may be rotated to use various parts of the upper and lower tools 17 and 19.

In the above described arrangement, the upper tool 17, having punched the workpiece W, is initially raised by the stripping spring 45 to be stripped out of the workpiece W and is then raised by the lift springs 65 together with the tubal guide member 47. Since the stripping spring 45 is strong in force, the upper tool 17 is kept in contact with the ram 11 when raised by the stripping spring 45, until the shoulder portion 37 of the same is brought into contact with the inner flange 49 of the tubal guide member 47. However, since the lift springs 65 are weak in force, they will momentarily delay the beginning of the rise the upper tool 17 together with the tubal guide member 47 after the shoulder portion 37 of the upper tool 17 has been brought up into contact with the inner flange 49 of the tubal guide member 47. Thus, it will be understood that the upper tool 17 will momentarily be out of contact with the ram 11 and will then be again brought into contact therewith by the lift springs 65 rapidly stretching when the upper tool 17 is being raised after punching the workpiece W.

According to the present invention, the mis-stripping of the upper tool 17 out of the workpiece W is detected when the upper tool 17 is not brought by the lift springs 65 into contact with the ram 11 after it has momentarily become out of contact therewith when raised after punching the workpiece W. Also, the workpiece W, which has been punched, is moved as soon as the upper tool 17 is brought by the lift springs 65 into contact with the ram 11 after it has momentarily become out of contact therewith.

Referring again to FIG. 2, in order to detect the contact of the upper tool 17 with the ram 11 being raised, the ram 11 is electrically insulated by an insulating means 73 from other portions of the turret punch press 1 and is connected to a detecting means 75. Also the upper tool 17 is grounded.

Figure 3:
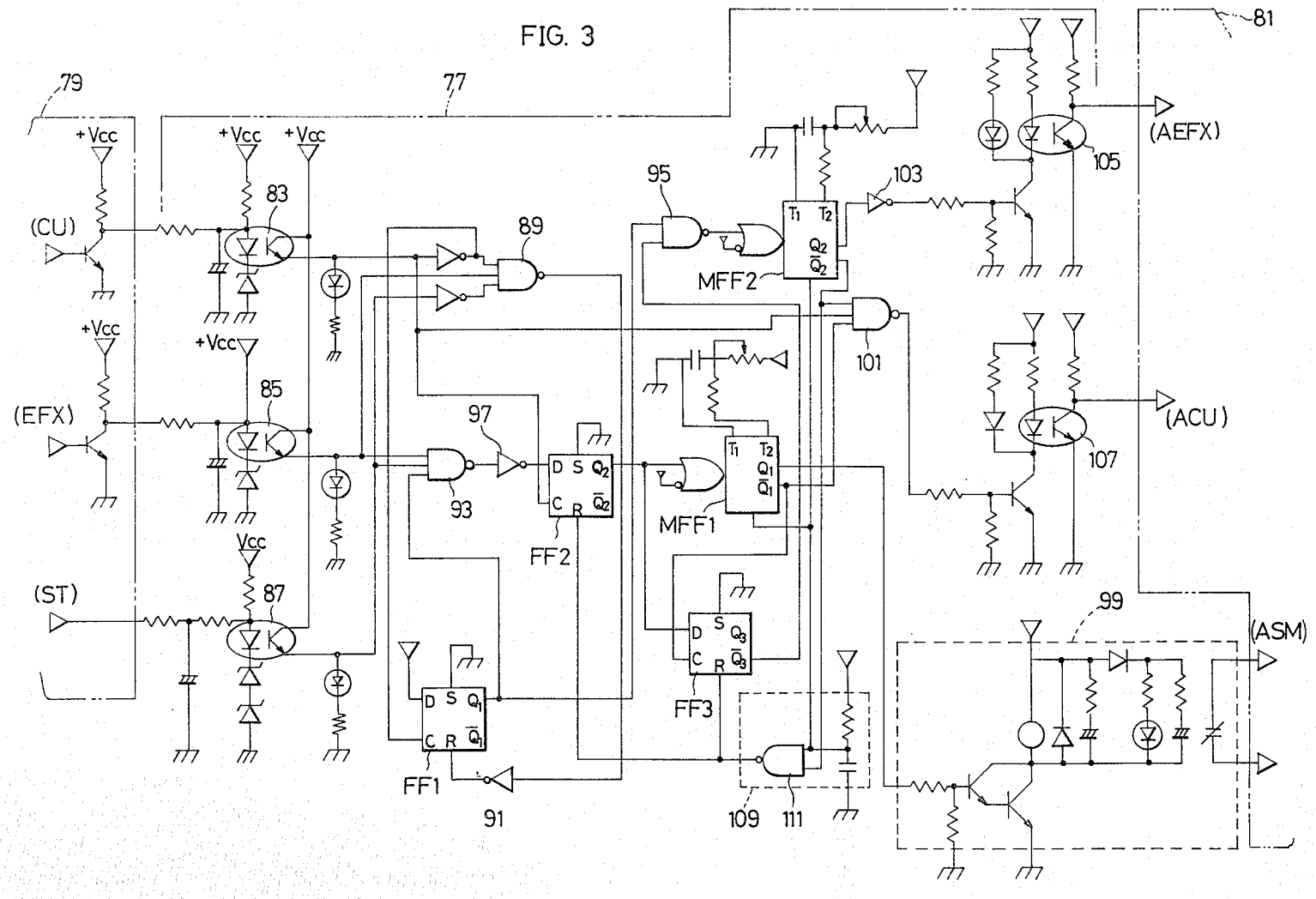
FIG. 3 is a control circuit embodying the principles of the present invention.

Referring to FIG. 3, there is shown a control circuit 77 of the detecting means 75 which is connected to a detecting means 79 and a numerical control means 81. The top dead center proximity signal (CU) in the detecting means 79 is outputted by a sensing means, such as a proximity switch, which is so arranged as to be actuated by a cam member fixed to the eccentric shaft 21 driving the ram 11 when the ram 11 is in the proximity of the top dead center. In the preferred embodiment, the top dead center proximity signal (CU) is of high voltage level (H) when the rotational angle of the eccentric shaft 21 is between 0° and 40° or between 320° and 360°, provided that the rotational angle is 0° when the ram 11 is at its top dead center and it is 180° when the ram 11 is at its bottom dead center. Also, the top dead center proximity signal (CU) is of low volage level (L) when the rotational angle of the eccentric shaft 21 is between 40° and 320°. The top dead center proximity signal (CU) is connected to the control circuit 77 through a photocoupler 83.

The punching completion proximity signal (EFX) in the detecting apparatus 79 is outputted by the sensing means which is actuated by the cam adjustably fixed on the eccentric shaft 21. In general, this punching completion proximity signal (EFX) becomes a high voltage level (H) only when the eccentric shaft 21 is between 265° and 345° of its stroke cycle and is connected to the control circuit 77 through a photo coupler 85.

The striker signal (ST) in the detecting means 79 corresponding to the detecting means 15 becomes a low voltage level (L), while the ram 11 and the upper tool 19 are in contact with each other, and in reverse, it becomes a high voltage level (H), while the ram 11 is brought out of contact with the upper tool 17. The striker signal (ST) is connected to the control circuit 77 through a photocoupler 87. The 'NAND' circuit 89 in the control circuit 77 produces an output when the top dead center proximity signal (CU) and the striker signal (ST) are low voltage levels (L) and the punching completion proximity signal (EFX) is a high voltage level (H). The incoming signal of the 'NAND' circuit 89 is inputted to a reset terminal R of a first flip-flop (FFI) through an inverter 91. The output $Q_1$ of the first flip-flop (FFI) becomes a high voltage level (H) when the top dead center proximity signal (CU) has fallen from a high voltage level (H) to a low voltage level (L). The input of $Q_1$ is inputted to the 'NAND' circuits 93 and 95.

The 'NAND' circuit 93 produces an output whereever the output $Q_1$ of the punching completion proximity signal (EFX), the striker signal (ST) and the first flip-flop (FF1) are all at a high voltage level (H). The output of the 'NAND' circuit 93 is inputted to the second flip-flop (FF2) through an inverter 97. The output $Q_2$ of the second flip-flop (FF2) becomes a high voltage level (H) when the top dead center proximity signal (ST) is a high voltage level (H) and the output of the 'NAND' circuit 93 falls to a low voltage level (L). The output $Q_2$ of the 'NAND' circuit 93 is inputted to the third flip-flop (FF3) and the first monomultivibrator (MFF1). The first monomutivibrator (MFF1) produces pulse signals at a proper time interval when its input changes from a low voltage level (L) to a high voltage level (H). The output $Q_1$ is applied to a numerical control means 81 as a mis-stripping signal (ASM) through a relay driving circuit 99. The output $\overline{Q}_1$ of the first monomultivibrator (MFF1) is applied to both the third flip-flop (FF3) and 'NAND' circuit 101.

The third flip-flop (FF3) produces an output $\overline{Q}_3$ wherein the second flip-flop (FF2) produces an output $Q_2$ and the first monomultivibrator (MFF1) produces an output $\overline{Q}_1$. The output $\overline{Q}_3$ is applied to the 'NAND' circuit 95. The 'NAND' circuit 95 produces an output wherein the first flip-flop (FF1) produces an output $\overline{Q}_1$ and the third flip-flop (FF3) produces an output $\overline{Q}_3$. The output of the 'NAND' circuit 95 is connected to the second monomultivibrator (MFF2). The output $Q_2$ of the second monomultivibrator (MFF2) is applied to the numerical control means 81 through an inverter 103 and a photocopular 105 as a punching completion signal for numerical control (AEFX).

The 'NAND' circuit 101 produces an output whenever the first monomultivibrator (MFF1) produces the output $\overline{Q}_1$ and the second monomultivibrator (MFF2) produces the output $\overline{Q}_2$. The output of the 'NAND' circuit 101 is applied to the numerical control means 81 through a photocoupler 107 as the top dead center signal for the numerical control (ACU). Numeral 109 in FIG. 3 designates the reset circuit which resets all flip-flops and monomultivibrators to their initial condition.

Figure 4:
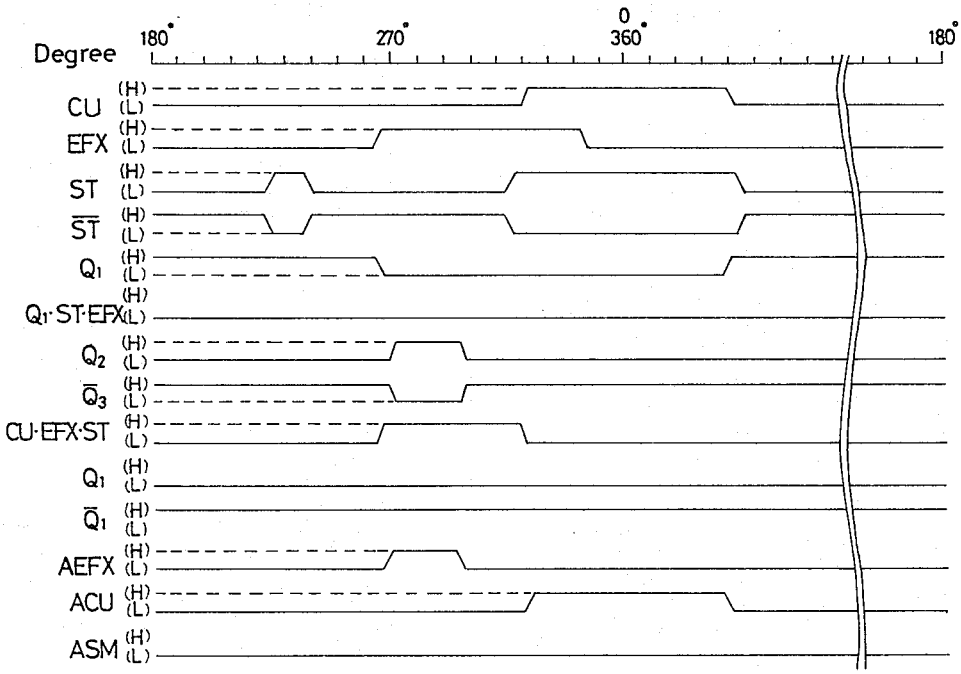
FIG. 4 is a timing diagram helpful in explaining the situation when punching operations are being normally made by the turret punch press.
Figure 5:
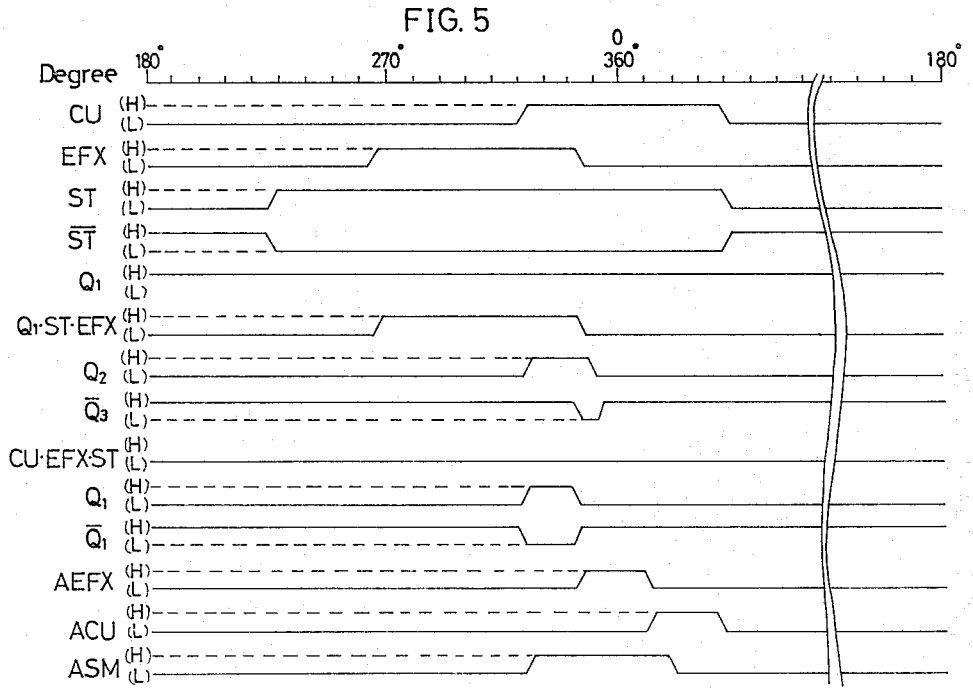
FIG. 5 is a timing diagram helpful in explaining the situation when mis-strippings occur in the turret punch press.

Referring to FIGS. 4 and 5, the function of the present invention will be described. When the punching operations are operating normally, on turning on the power switch to the punch press, the second and the third flip-flop (FF2), (FF3) are cleared by changing the output signal of a 'NAND' circuit 111 in the reset circuit 109 from a low voltage level (L) to a high voltage level (H). Also, the top dead center proximity signal (CU) and the punching completion signal (EFX) in the detecting means 79 are inputted with the high voltage level (H) and the low voltage level (L), respectively, by the signal sent from the sensing means, such as a proximity switch actuated by a cam member fixed to the eccentric shaft 21. On the other hand, the striker signal in the detector is inputted with the high voltage level (H) since the ram 11 and the upper tool 17 are not in contact with each other.

When the eccentric shaft 21 has rotated around 40° from the top dead center, namely 0° after the starting of the ram 11, the top dead center proximity signal (CU) will fall from a high level (H) to low level (L) and the output $Q_1$ of the first flip-flop (FF1) will rise from a low voltage level (L) to a high voltage level (H), since the first flip-flop (FF1) receives the signal (CU) from the input terminal (C). However, the output signals of the other circuits will not be changed. When the eccentric shaft 21 is further rotated to bring down the ram 11 into contact with the upper tool 17, the striker signal (ST) will fall from the high voltage level (H) to the low voltage level (L). In this condition, the ram 11 will reach the bottom dead center and cause the upper and lower tools 17 and 19 to punch the workpiece W. It will then begin to rise as the workpiece W has been punched.

As soon as the upper tool 17 is raised by the stripping spring 45 to bring the shoulder portion 37 into contact with the inner flange 49, the striker signal (ST) will rise from the low voltage level (L) to the high voltage level (H), since the upper tool 17 will momentarily become out of contact with the ram 11. However, the striker signal (ST) will again fall to the low voltage level (L), since the upper tool 17 will be immediately raised by the lift springs 65 into contact with the ram 11. In this condition, the punching completion proximity signal (EFX) will rise from the low voltage level (L) to the high voltage level (H) and the reset terminal (R) of the first flip-flop (FF1) will receive a signal which changes state from the low voltage level (L) to the high voltage level (H) since the output of the 'NAND' circuit 89 will fall from the high voltage level (H) to the low voltage level (L). As the result, the first flip-flop will be cleared and the output $Q_1$ will fall from the high voltage level (H) to the low voltage level (L). Since the output signal $Q_1$ changes from the low voltage level (L) to the high voltage level (H) because of the falling of the output $Q_1$, the second monomultivibrator (MFF2) will be actuated to output pulse signals having a certain pulse swing from the output terminal $Q_2$. Accordingly, the pulse signal is outputted as the punching completion signal for the numerical control (AEFX) to the numerical control means of the turret punch press 1 through the inverter 103 and the photocoupler 105. By taking the 'NAND' of the outputs $Q_1$ and $Q_2$ in the first and second monomultivibrators (MFF1)(MFF2) and the top dead center proximity signal (CU), the top dead center signal (CU) is useful in avoiding the troubles of the numerical control sequence in the numerical contol means which is caused by the punching completion signal (EFX) and mis-stripping signal (ASM) falling at the top dead center. In, case that mis-stripping does not occur (output $\overline{Q}_1$ is a high voltage level (H) or the workpiece movement command (AEFX) is not outputted (output $\overline{Q}_2$ is a high voltage level (H)), the high voltage level signal (H) is outputted to the numerical control means as an output of the 'NAND' circuit 101 when the top dead center proximity signal (CU) is a high voltage level (H). As described above, the workpiece W can start to move as soon as the punch is brought out of contact with the workpiece W by catching the signal when the striker signal (ST) rises from the low voltage level (L) to the high voltage level (H) and falls to the low voltage level (L) again.

Next, when a mis-stripping occurs, the upper tool 17 will be caught in the workpiece W and cannot be stripped out of the workpiece W after punching. Accordingly, only the ram 11 will rise and the upper tool 17 will not rise, and therefore the upper tool 17 will not be brought into contact with the ram 11 after the ram 11 is raised out of contact with the workpiece W. Thus, the mis-stripping signal (ASM) is outputted to the numerical control means to stop the punching operation.

Referrring to FIGS. 3 and 4, when the upper tool 17 is in the workpiece W for mis-stripping, only the ram 11 rises. When the ram 11 is brought out of contact with the punch 17, the striker signal (ST) changes from a low voltage level (L) to a high voltage level (H), and this high voltage level (H) condition is continued. When the punching completion signal (EFX) rises from a low voltage level (L) to a high voltage level (H) at the position where the eccentric shaft 21 reaches 265° of its stroke cycle, the output of the 'NAND' circuit 93 falls from the high voltage level (H) to the low voltage level (L). Then, the high voltage level (H) signal is supplied to the terminal (D) of the second flip-flop (FF2) through an inverter 97, since the top dead center proximity signal (CU) changes from the low voltage level (L) to the high voltage level (H) when the eccentric shaft 21 reaches 320° of its stroke cycle to cause the output $Q_2$ of the second flip-flop to change from a low voltage level (L) to a high voltage level (H). As a result, the first mono-multivibrator (MFF1) is actuated and pulse signals having certain pulse swings are outputted from the output $Q_1$ and are connected to the relay drive means 99. The relay of that drive means 99 produces pulse signals having 20–30 msec, for example, of response time to the numerical control means as the mis-stripping signal (ASM).

Although a preferred form of the present invention has been illustrated and described, it should be understood that the device is capable of modification by one skilled in the art without departing from the principles of the invention. Accordingly, the scope of the invention is to be limited only by the claims appended hereto.

I claim:

1. A method of controlling the movement of a workpiece to be processed in a punch press, comprising the steps of:

moving the workpiece into an operative position in order to be processed by said punch press;

lowering the upper tool of said punch press by means of a ram in order to process said workpiece;

raising said ram after its lowering of said upper tool, thereby momentarily removing said ram out of contact with said upper tool;

detecting when said ram has returned to the proximity of the top dead center of its driving shaft;

detecting when the workpiece processing operation has been completed; and moving the processed workpiece out of the operative position after detecting said upper tool contacting said ram, said ram has returned to the proximity of the top dead center of its driving shaft and the workpiece processing operation has been completed.

2. Apparatus for controlling the movement of a workpiece to be processed in a punch press having a ram driven into contact with an upper tool in order to process the workpiece, comprising:

driving means for operating said ram to contact said upper tool to operate upon said workpiece, said driving means functioning to allow said ram to return to the proximity of its top dead center after contacting said upper tool, said ram thus momentarily being out of contact with said upper tool;

first means for detecting when said upper tool again contacts said ram and producing a first signal thereupon;

second means for detecting when said ram has returned to the proximity of the top dead center of the driving means and producing a second signal thereupon;

third means for detecting the completion of the workpiece processing operation and producing a third signal thereupon; and means for causing the movement of the completed workpiece out of a processing position upon receiving said first, second and third signals.

3. The apparatus of claim 2, further including means for monitoring the correct operation of said first, second and third means for detecting.

4. The apparatus of claim 2, wherein said driving means comprises an eccentric shaft.

* * * * *